United States Patent [19]

Bell

[11] Patent Number: 4,524,706

[45] Date of Patent: Jun. 25, 1985

[54] TRIM ATTACHING MACHINE AND METHOD

[75] Inventor: James D. Bell, Campbellsville, Ky.

[73] Assignee: Union Underwear Company, Inc., Bowling Green, Ky.

[21] Appl. No.: 305,402

[22] Filed: Sep. 25, 1981

[51] Int. Cl.[3] ..... D05B 19/00

[52] U.S. Cl. ..... 112/121.29; 112/130

[58] Field of Search ..... 112/122, 130, 121.29, 112/304

[56] References Cited

U.S. PATENT DOCUMENTS

| | | | |
|---|---|---|---|
| 3,610,493 | 10/1971 | Brocklehurst | 112/130 |
| 3,871,309 | 3/1975 | Frost | 112/130 |
| 3,986,467 | 10/1976 | Hornkohl | 112/130 |

*Primary Examiner*—Henry S. Jaudon

*Attorney, Agent, or Firm*—Darby & Darby

[57] ABSTRACT

A conveyor belt carries a plurality of cut pieces of fabric in succession to an edge trimmer which successively cuts a trim edge on each cut piece along a predetermined straight line. A band of trim of double thickness is placed in tension and sewed to the cut pieces to overlap the trim edges thereof. The trim edges are closely spaced together to reduce trim waste. A forwardmost cut piece is separated from the next following cut piece so as to increase blade clearance between them. The resulting blade clearance is large enough to permit the forwardmost cut piece to be severed from the next following cut piece by a blade which cuts that intermediate band section which joins the two. The served cut piece is then picked up and dropped to fall flat on top of a stack.

14 Claims, 3 Drawing Figures

TRIM ATTACHING MACHINE AND METHOD

BACKGROUND OF THE INVENTION

This invention pertains to textile machinery, and more particularly pertains to textile machinery which attaches fabric trim to cut pieces of fabric.

When mass-producing articles of clothing, it is conventional practice to make parts of a garment from flat pieces of fabric that are cut to the pattern desired and subsequently stitched together. For example, to make an arm for a piece of thermal underwear or other knit garment, a flat piece of fabric is cut into a shaped piece which, when sewed together, will form a sleeve covering the arm of a wearer from, e.g., slightly below the wrist up to the shoulder and the armpit. Articles of clothing such as long underwear can be trimmed at the wrists or ankles by attaching a piece of fabric trim to the cut piece. The piece of trim will encircle the wrist or ankle in the form of a cuff once the cut piece and the trim are properly sewn together.

It is possible to cut individual trim pieces and then to individually sew a piece of trim on each cut piece. This is labor-intensive and requires strict quality control, and is therefore expensive. It would be desirable to provide a machine which would trim each cut piece mechanically.

It is an object of the invention to provide a method and a machine which would permit a plurality of cut pieces to be trimmed with fabric trim in a continuous operation, thereby realizing economies of mass production.

It is a further object of the invention to provide a method and a machine which would minimize wasted fabric during trimming of the cut pieces.

It is another object of the invention to provide a method and a machine which would be convenient in use and reliable in operation, yet relatively simple and inexpensive in construction and use.

In accordance with the invention, trim is attached to the cut pieces in a continuous process, providing a continuous supply of finished sub-assemblies. These may be quickly and efficiently formed into a garment component for application to a garment. An illustrative embodiment of the invention has a means for transporting cut pieces, such as a conveyor belt, on which the cut pieces are placed. The cut pieces are aligned in a row and overlap each other so that those regions of the cut pieces to which the trim is to be attached are closely spaced and are non-overlapping with adjacent cut pieces. A continuous band of trim is provided, for example from a spool, and is fed to a sewing location to which the cut pieces are successively transported. As the band meets the succession of cut pieces at the sewing location, the band is sewn thereto, so that a plurality of cut pieces are successively attached to the band one by one and joined together thereby.

The band and the cut pieces sewn thereto are then transported to another location in which adjacent cut pieces are separated from each other by cutting the intermediate band sections which join them while leaving each cut piece attached to a length of the band. The cut pieces are thus trimmed, making it unnecessary to handle each cut piece individually.

Advantageously, the invention places the band in tension prior to attaching it to the cut pieces, preventing the trim from bagging or bunching up. Further advantageously, adjacent pieces which have been sewn to the band are separated prior to cutting the intermediate band section which joins them. This allows minimization of the gap between adjacent cut pieces and reduction in trim waste, while still ensuring enough blade waste, while still ensuring enough blade clearance between adjacent cut pieces.

Further advantageously, the invention can cut trim edges on all the cut pieces along a predetermined straight line so that the band is sewn to the cut pieces in a uniform fashion. Further advantageously, the invention can stack finished cut pieces with lengths of trim attached thereto.

BRIEF DESCRIPTION OF THE DRAWINGS

The drawings illustrate an embodiment of the invention which is presently preferred but which is nonetheless merely illustrative of the invention. Specifically.

DETAILED DESCRIPTION OF A PREFERRED EMBODIMENT

Figure 1:
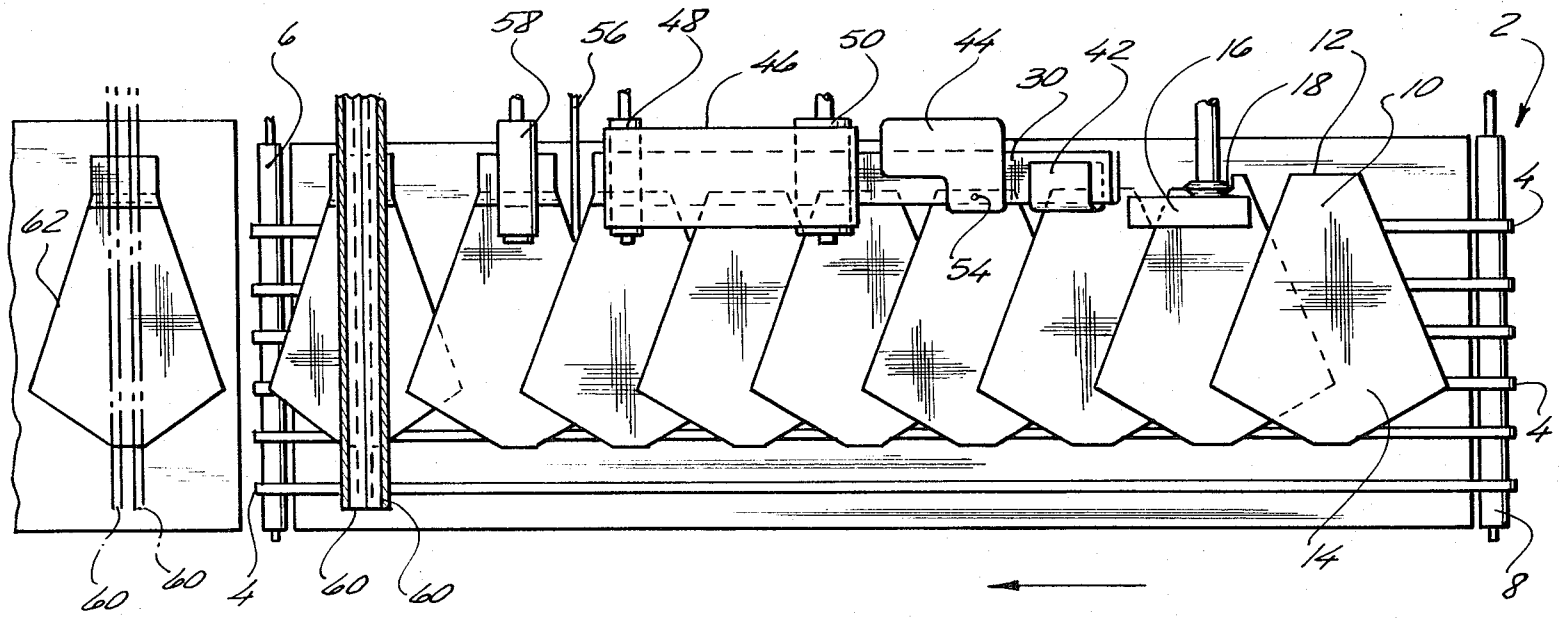
FIG. 1 shows a top view of the invention.
Figure 2:
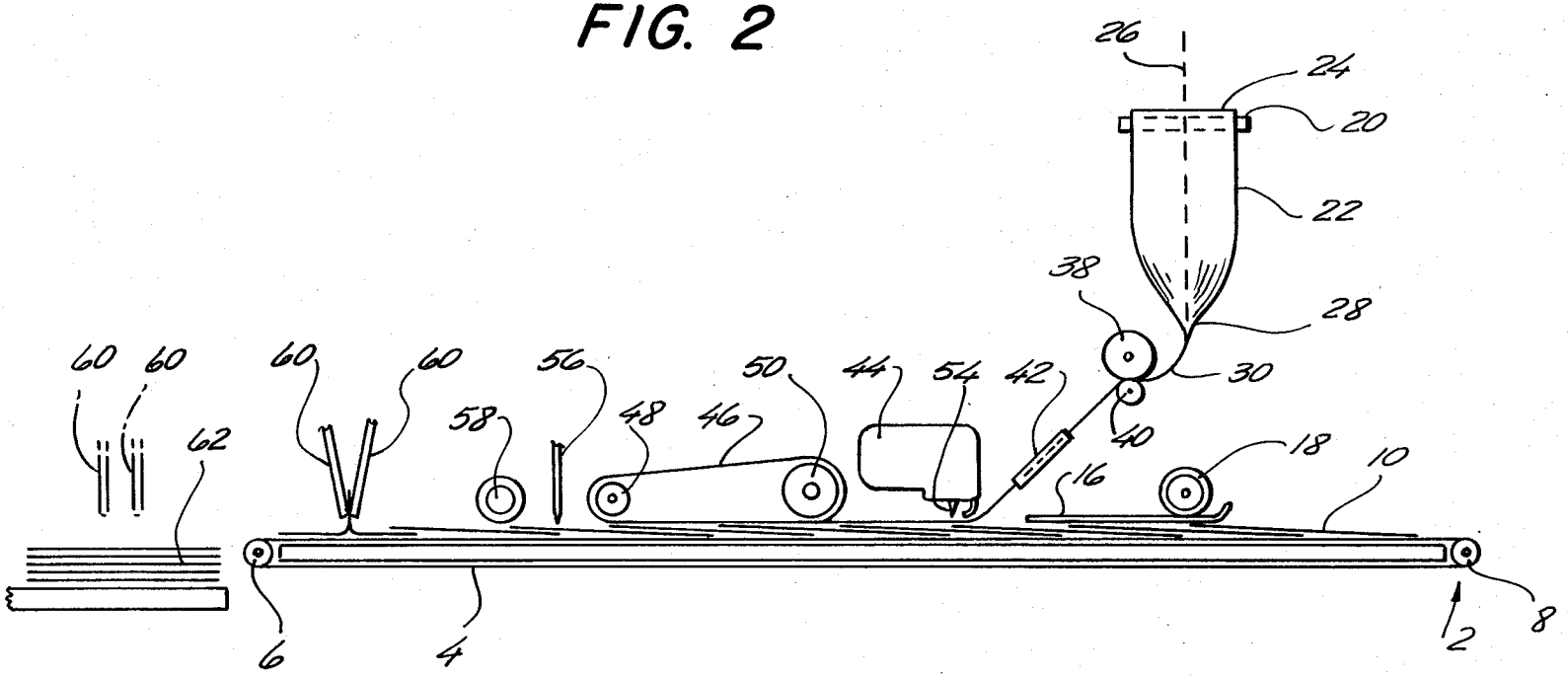
FIG. 2 shows a side view of the invention.

In the drawings, each element is always indicated by the same reference numeral, regardless of the view in which the element appears. In FIGS. 1 and 2, a conveyor belt generally indicated by reference numeral 2 is formed from a plurality of parallel and horizontal conveyor bands 4, which are looped over and driven by transverse horizontal rollers 6 and 8. Conveyor belt 2 is horizontal, and is driven such that a plurality of cut pieces 10 placed on top of conveyor belt 2 are transported forwardly in succession in the direction shown by the arrow (to the left) in FIG. 1. The conveyor belt 2 may be replaced by any other suitable structure, and need not have a plurality of spaced-apart conveyor bands 4.

Each cut piece 10 has a region 11 which will be cut down to trim edge 12, which later will be overlapped by trim as set forth below. Cut pieces 10 shown in the drawings are here of a shape which is used to make a sleeve for a piece of long underwear, but the invention can apply trim to cut pieces of any shape.

Cut pieces 10 are wider at their regions 14, i.e., are wider at the shoulder end of each cut piece 10. Trim will only be attached to each cut piece 10 at its trim edge 12. In order to minimize trim waste, cut pieces 10 are overlapped on conveyor belt 2 as closely as possible without causing any trim edge 12 to overlap any portion of any other cut piece 10 after trim edges 12 have been cut.

As each cut piece 10 is moved to the left in FIG. 1 by conveyor belt 2, it passes underneath a fixed presser foot 16 which is elongated in a direction parellel to conveyor belt 2. Presser foot 16 keeps each cut piece 10 fixed with respect to conveyor belt 2 while a rotating circular edge trimmer 18 successively cuts the trim edges 12 of each cut piece 10 along a predetermined straight line 15 (FIG. 3) by rotating in a horizontal axis which is normal to conveyor belt 2 and intersects line 15. A rotating transversely extending pressure roller (not shown) can be placed beneath cut pieces 10 directly below presser foot 16 to prevent slippage of the cut pieces 10 as trim edges 12 are being cut. Edge trimmer 18 may be eliminated if cut pieces 10 are sufficiently uniform and if they are placed on the convey or belt 2 with sufficient accuracy, but this is usually inconvenient and undesirable.

Figure 3:
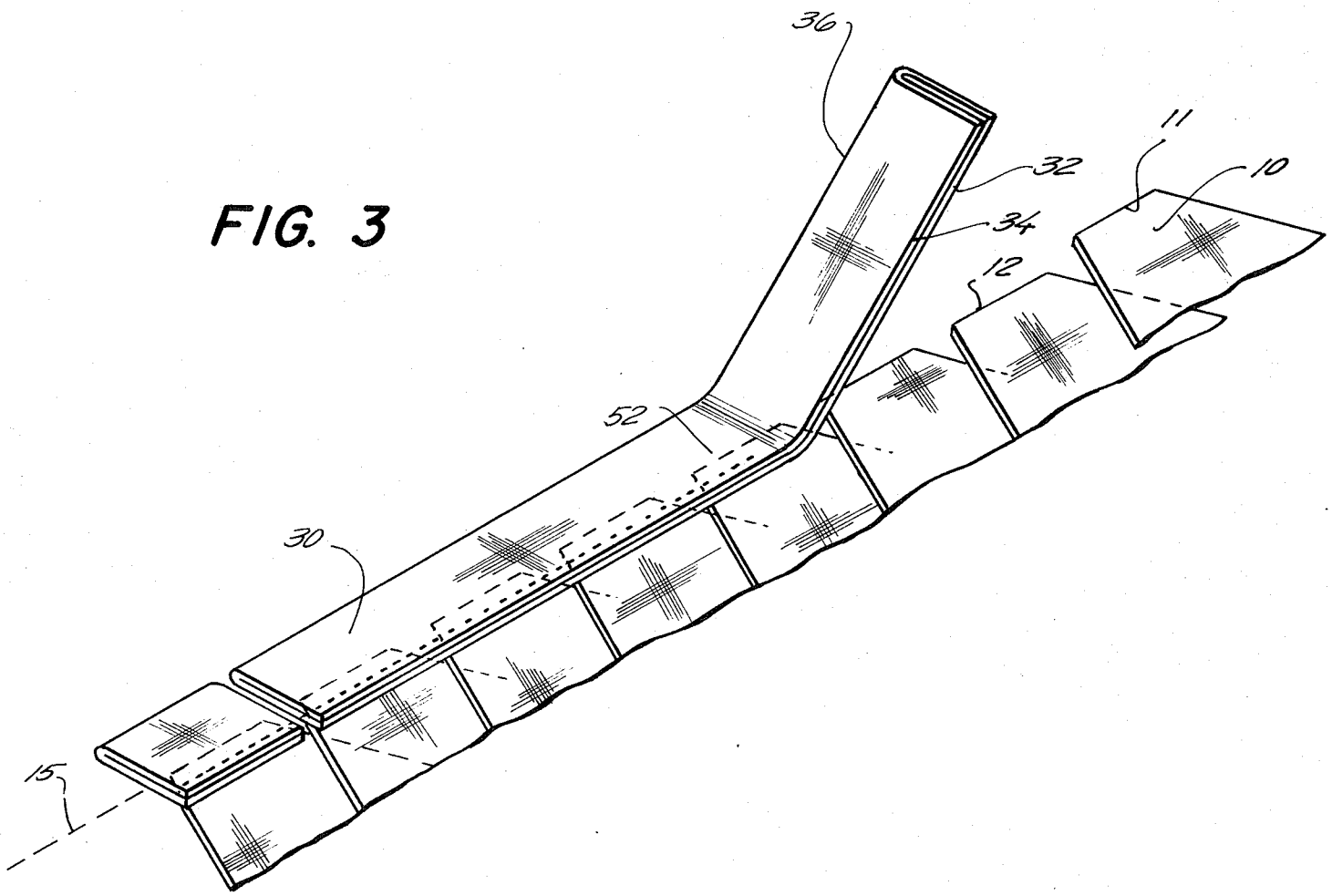
FIG. 3 shows how the invention attaches trim to individual cut pieces.

A horizontal bar 20 is suspended above edge trimmer 18 and parallel to conveyor belt 2. Bar 20 supports a strip 22 of fabric trim which is rolled up, as on a spool 24. Strip 22 is folded along its centerline 26 by a suitable folding means 28, to create a band 30. The folding means 28 is conventional, and may include a V-shaped plate or other element. Since folding means 28 is known, it will not be described further. Additionally, any other means for feeding strip 22 can be substituted. Such means are known by themselves. As can be seen in FIG. 3, edges 32 and 34 of strip 22 are aligned with each other opposite the folded side 36 of band 30. Band 30 need not be of a double thickness such as is shown in this example; a band 30 of only a single thickness may be used where the application permits, by using a strip 22 of an appropriate size and eliminating folding means 28.

Band 30 then passes between a rotatable tension roll 38 and an associated motor-driven pressure roller 40, which together feed band 30. Band 30 next passes downwardly and forwardly through a trim guide 42 which aligns band 30 parallel to line 15 but keeps band 30 off conveyor belt 2. After passing through trim guide 42, band 30 passes horizontally forwardly beneath a sewing machine 44 and then passes underneath the rear end of horizontal and longitudinally extending belt 46. Belt 46 engages both cut pieces 10 and belt 30.

Belt 46 is driven by transverse horizontal rollers 48 and 50 in that direction shown by the arrow (clockwise) in FIG. 2. The linear transporting speed of the outer surface of belt 46 is greater than the linear transporting speed of the surface of tension roll 38. Because belt 46 frictionally engages band 30, band 30 will be in tension between roller 50 and tension roll 38. The tension can be adjusted by changing the linear transporting speed of tension roll 38 and pressure roller 40. If the characteristics of the fabrics permit, tension roll 38 and pressure roller 40 may be eliminated.

As each of a succession of cut pieces 10 reaches sewing machine 44, band 30 is guided thereto to meet a cut piece 10 at a sewing location 52, which is located directly beneath needle 54 of sewing machine 44. As can best be seen in FIG. 3, band 30 is so guided that edges 32 and 34 are parellel to and overlap the trim edge 12 of each cut piece 10. Thus, when sewing machine 44 sews band 30 to each cut piece 10, both edges 32 and 34 are sewn together and the trim is securely attached to cut pieces 10 in succession. Sewing machine 44 is conventional and will not be described further.

In order to maximize the output of the machine, conveyor belt 2 and pressure roller 40 are synchronized, as by belts (not shown), to move at the same linear speed, which speed is chosen to coincide with the speed of operation of sewing machine 44. Thus, the rates at which band 30 is rolled off spool 24 and at which the cut pieces 10 are fed to sewing machine 44 are identical.

Belt 46 is synchronized with conveyor belt 2 and pressure roller 40 as by a variable-ratio transmission (not shown). In this example, band 30 can be stretched to 200% of its original length, but the variable-ratio transmission is preferably adjusted to stretch band 30 to 140% of its original length, since this provides adequate tension for belt 30. Thus, rollers 48 and 50 and belt 46 preferably rotate at 140% of the linear transporting speed of conveyor belt 2.

After a given cut piece 10 has been sewn to band 30 by sewing machine 44, both are advanced forwardly by conveyor belt 2 and pass underneath belt 46. If desired, another transverse horizontal pressure roller or rollers (not shown) can be located below the cut pieces 10 directly beneath belt 46 in order to increase frictional engagement between conveyor belt 2, cut pieces 10, band 30 and belt 46. Between roller 48 and needle 54, conveyor belt 2 supports a plurality of cut pieces 10 which are all attached to band 30. As the cut pieces 10 with band 30 attached thereto are moved forwardly of roller 48, they pass a vertical and transversely extending blade 56. Only a tiney portion of each cut piece 10 passes directly beneath blade 56. As will be seen below, blade 56 should not cut any cut piece 10, but should rather cut intermediate sections of band 30 alone. After passing blade 56, cut pieces 10 with band 30 attached thereto are passed below horizontal transverse roller 58.

Roller 58 has approximately the same width as band 46 and is located forwardly of it. Roller 58 may be located above another transverse horizontal pressure roller (not shown) so that friction between roller 58 and the cut pieces 10 is increased. Roller 58 is spaced from roller 48 such that when a forwardmost cut piece 10 is frictionally engaged by roller 58, the next following cut piece 10 will be frictionally engaged by belt 46 below roller 48.

The surface of roller 58 has a faster linear transporting speed which is about 20% greater than that of the outermost surface of belt 46. As a result of this speed differential, the forwardmost cut piece 10 will be accelerated relative to the next following cut piece 10 and these two cut pieces 10 will thus be separated from each other, and that intermediate section of band 30 which joins them will be stretched. As a result, there will be a greater clearance between these two adjacent cut pieces 10 and the tautness of the intermediate section of band 30 will be increased. Blade 56 can sever the forwardmost cut piece 10 from the next following cut piece 10 by cutting the intermediate section of band 30 which joins them. Since band 30 is off to the side of conveyor belt 2, conveyor belt 2 will not be cut by blade 56. The increased blade clearance between these two adjacent cut pieces 10 minimizes the likelihood that blade 56 will cut either of the cut pieces 10 rather than cutting band 30 alone. Further, trim waste is reduced, since no sections of band 30 are discarded. Blade 56 is operated automatically by a photodetector (not shown). The photodetector is located near conveyor belt 2. When adjacent cut pieces are separated from each other, an open generally triangular gap is formed between them and the intermediate section of band 30 which joins them. This gap permits light from a light source (not shown) located, e.g. below conveyor belt 2 to strike the photodetector located, e.g., above conveyor belt 2. Thus, an electrical control signal is generated when adjacent cut pieces are separated from each other, and causes blade 56 to cut band 30 automatically. If desired, a suitable fixed mating blade or other element (not shown) can be placed below band 30 parallel to blade 56, to increase the sharpness of the cut.

After a cut piece 10 with a length of trim attached thereto has been severed by blade 56, that cut piece 10 is picked up by two transversely extending pincers 60. Pincers 60 are then moved forwardly along a suitable suspended track (not shown) and are subsequently opened up. The separated cut piece 10 will then fall flat on a stack 62 of other separated cut pieces 10. Such a stacking means is conventional, and will not be desribed further. If stacking is not desired, pincers 60 and the apparatus associated therewith may be eliminated.

Although a preferred form of the invention has been disclosed for illustrative purposes, those skilled in the art will appreciate that many additions, modifications or substitutions can be made without departing from the scope and spirit of the invention as defined in the accompanying claims.

What is claimed is:

1. A machine for successively attaching fabric trim to a plurality of cut pieces of fabric at an edge of each cut piece, the cut pieces being spaced apart from each other such that said edges of adjacent cut pieces are non-overlapping with said adjacent cut pieces, comprising:

means for successively transporting a plurality of cut pieces to a sewing location;

means for feeding a continuous band of fabric trim to the sewing location in such a manner that the band meets the cut pieces in succession and overlaps said edges;

means for successively sewing the band to the cut pieces at the sewing location;

means for increasing the distance between adjacent cut pieces; and means for cutting the band intermediate adjacent cut pieces, after the distance between them is increased, thereby separating said cut pieces.

2. The machine defined by claim 1, further comprising an edge trimmer for cutting a trim edge on each cut piece along a predetermined straight line prior to transportation of that cut piece to the sewing location.

3. The machine defined by claim 1, wherein said means for increasing comprises a first element frictionally engaging a forwardmost cut piece for movement in a forward direction and a second element frictionally engaging a next following cut piece for movement in said forward direction, the first element moving the forwardmost cut piece faster than the second element moves the next following cut piece.

4. The machine defined by claim 3, wherein said means for cutting is located between the first element and the second element.

5. The machine defined by claim 3, wherein said means for transporting comprises a conveyor belt which, when moving forwardly, successively passes said means for feeding, said means for sewing, the second element, said means for cutting, and the first element, in that order.

6. The machine defined by claim 5 further comprising means for tensioning the band in a manner that the band is in tension when it is being sewn to the cut pieces by said means for sewing.

7. The machine defined by claim 6, wherein said means for tensioning includes the second element.

8. The machine defined by claim 7, wherein the second element provides a faster linear transporting speed than said means for feeding.

9. The machine defined by claim 8, wherein said means for sewing is located between the second element and said means for feeding.

10. The machine defined by claim 8, wherein said means for feeding receives a rolled strip of trim and further comprises means for folding the strip onto itself along a centerline thereof and creating a folded band of double thickness and feeding said band in a manner that both edges of the strip overlap said edges of the cut pieces.

11. The machine defined by claim 3, wherein the first element comprises a rotating roller.

12. The machine defined by claim 3, wherein the second element comprises an elongated moving belt.

13. The machine defined by claim 1, further comprising a stacking means for stacking cut pieces in a stack after they have been severed by said means for cutting.

14. A machine for successively attaching fabric trim to a plurality of cut pieces of fabric over a trim edge of each cut piece, the cut pieces being spaced apart from each ofher such that the trim edges of adjacent cut pieces are nonoverlapping with said adjacent cut pieces, comprising:

band folding and feeding means for receiving a rolled strip of fabric trim, folding the strip onto itself along a centerline thereof and creating a folded band of double thickness which has both edges of the strip aligned with each other, and feeding the band parallel to a predetermined straight line to a sewing location;

edge trimming means for successively cutting a trim edge on each cut piece along said line;

means for successively tensioning the band at the sewing location;

means for successively sewing the tensioned band to the cut pieces at the sewing location in a manner that both edges of the strip overlap the trim edges of the cut pieces;

means for increasing the distance between adjacent cut pieces after the band has been sewn thereto;

means for severing the band intermediate said adjacent cut pieces after the distance therebetween has been increased, thereby separating them;

means for stacking a cut piece in a stack after that cut piece has been severed form an adjacent cut piece; and a conveyor belt carrying a plurality of cut pieces forwardly in succession past said edge trimming means, said means for sewing, said means for separating, and said means for cutting, to said means for stacking.

* * * * *